US010758454B2

(12) United States Patent
Torres

(10) Patent No.: US 10,758,454 B2
(45) Date of Patent: Sep. 1, 2020

(54) PILL CRUSHING ASSEMBLY

(71) Applicant: Raul Torres, Cypress, CA (US)

(72) Inventor: Raul Torres, Cypress, CA (US)

( * ) Notice: Subject to any disclaimer, the term of this patent is extended or adjusted under 35 U.S.C. 154(b) by 346 days.

(21) Appl. No.: 15/466,920

(22) Filed: Mar. 23, 2017

(65) Prior Publication Data

US 2018/0271751 A1 Sep. 27, 2018

(51) Int. Cl.

| | |
|---|---|
| ***B02C 19/08*** | (2006.01) |
| ***A61J 7/00*** | (2006.01) |
| ***B26D 3/30*** | (2006.01) |
| ***B26D 1/26*** | (2006.01) |

(52) U.S. Cl.

CPC ..... *A61J 7/0007* (2013.01); *B02C 19/08* (2013.01); *B26D 1/26* (2013.01); *B26D 3/30* (2013.01)

(58) Field of Classification Search

CPC ..... A61J 7/0007; B02C 19/08; B26D 1/00; B26D 1/26; B26D 3/30

USPC ..... 241/199, 205, 199.12, 169; 83/136–143; 30/120.2, 124; 225/103

See application file for complete search history.

(56) References Cited

U.S. PATENT DOCUMENTS

| | | | | |
|---|---|---|---|---|
| 2,318,911 | A * | 5/1943 | Zweber | A61J 7/0007 241/169.1 |
| 2,602,596 | A * | 7/1952 | Jones | A61J 7/0007 241/169.1 |
| 2,631,786 | A * | 3/1953 | Morgan | A61J 7/0007 241/169 |
| 4,121,775 | A | 10/1978 | Roseberg et al. | |
| 4,212,430 | A | 7/1980 | Dale et al. | |
| 4,366,930 | A * | 1/1983 | Trombetti, Jr. | A61J 7/0007 241/169 |
| 4,967,971 | A * | 11/1990 | Smith | A61J 7/0007 241/169 |
| 5,118,021 | A * | 6/1992 | Fiocchi | A61J 7/0007 225/103 |
| 5,863,001 | A | 1/1999 | Schulze | |
| 6,637,683 | B1 | 10/2003 | (Lomax) Wilbur | |
| D695,067 | S | 12/2013 | Wilson et al. | |
| 8,720,807 | B2 * | 5/2014 | Priebe | A61J 7/0007 241/169 |

FOREIGN PATENT DOCUMENTS

| | | |
|---|---|---|
| WO | WO2004082837 | 9/2004 |

* cited by examiner

*Primary Examiner* — Evan H MacFarlane
*Assistant Examiner* — Nhat Chieu Q Do

(57) ABSTRACT

A pill crushing assembly for crushing and cutting a pill includes a plunger unit that may be manipulated. A base is provided and the base may be positioned on a support surface. A pill is selectively positioned on the base. The plunger unit is selectively positioned on the base. Thus, the plunger unit selectively crushes the pill on the base.

6 Claims, 3 Drawing Sheets

PILL CRUSHING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to crushing devices and more particularly pertains to a new crushing device for crushing and cutting a pill.

BRIEF SUMMARY OF THE INVENTION

An embodiment of the disclosure meets the needs presented above by generally comprising a plunger unit that may be manipulated. A base is provided and the base may be positioned on a support surface. A pill is selectively positioned on the base. The plunger unit is selectively positioned on the base. Thus, the plunger unit selectively crushes the pill on the base.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
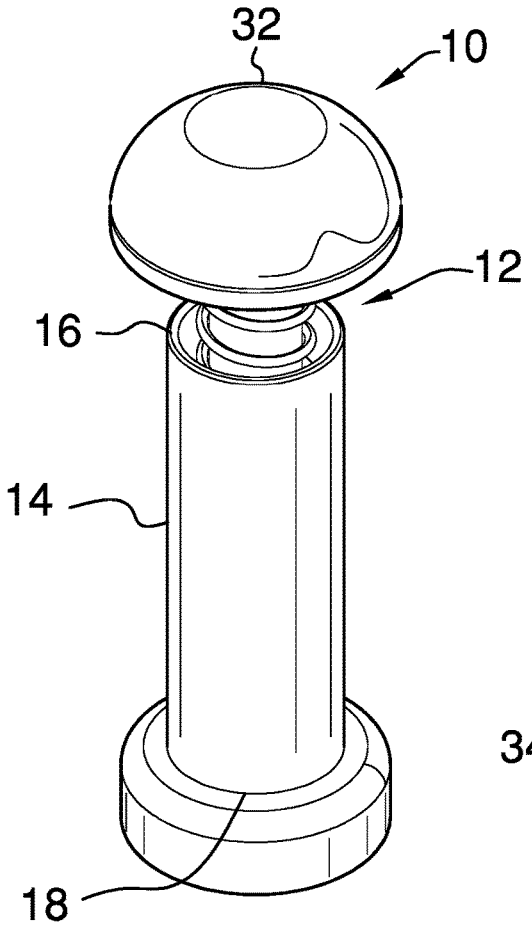
FIG. 1 is a perspective view of a pill crushing assembly according to an embodiment of the disclosure.
Figure 2:
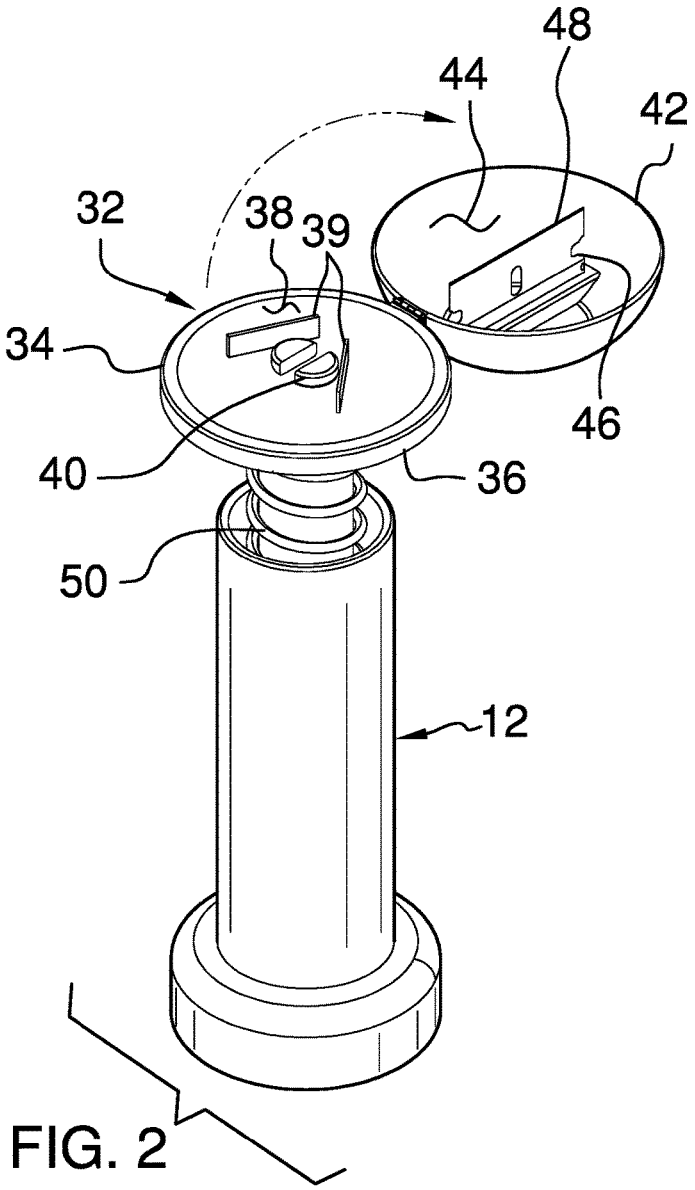
FIG. 2 is a perspective view of an embodiment of the disclosure showing a lid in an open position.
Figure 3:
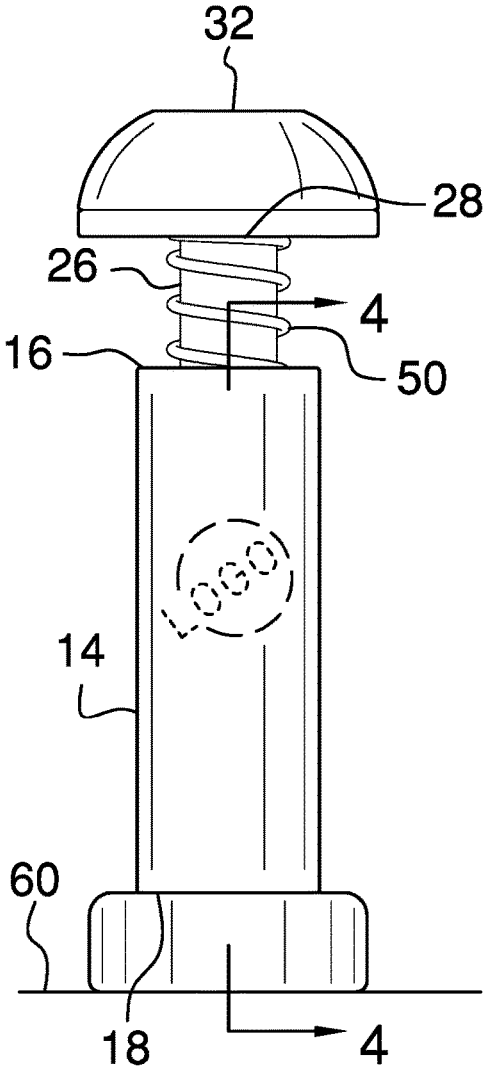
FIG. 3 is a front view of an embodiment of the disclosure.
Figure 4:
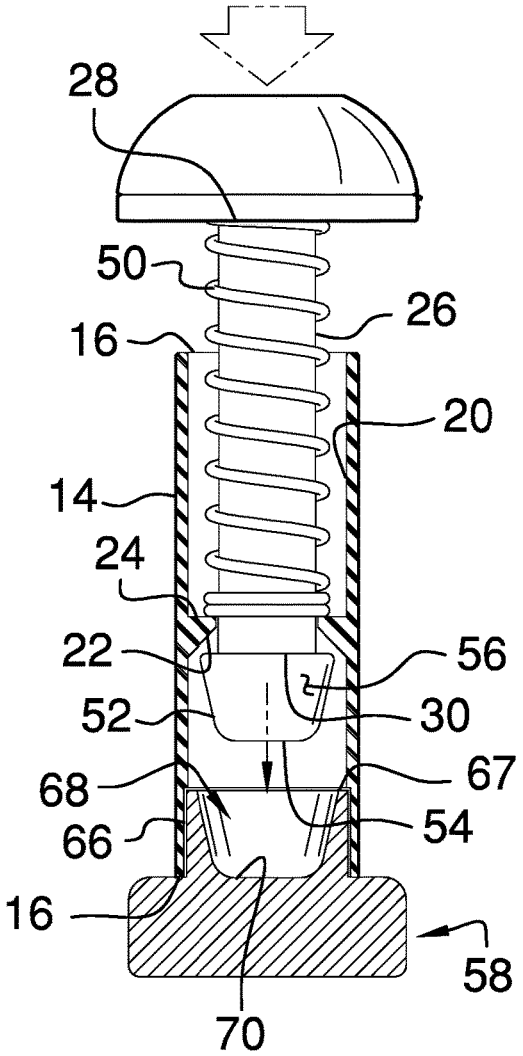
FIG. 4 is a cross sectional view taken along line 4-4 of FIG. 3 of an embodiment of the disclosure.
Figure 5:
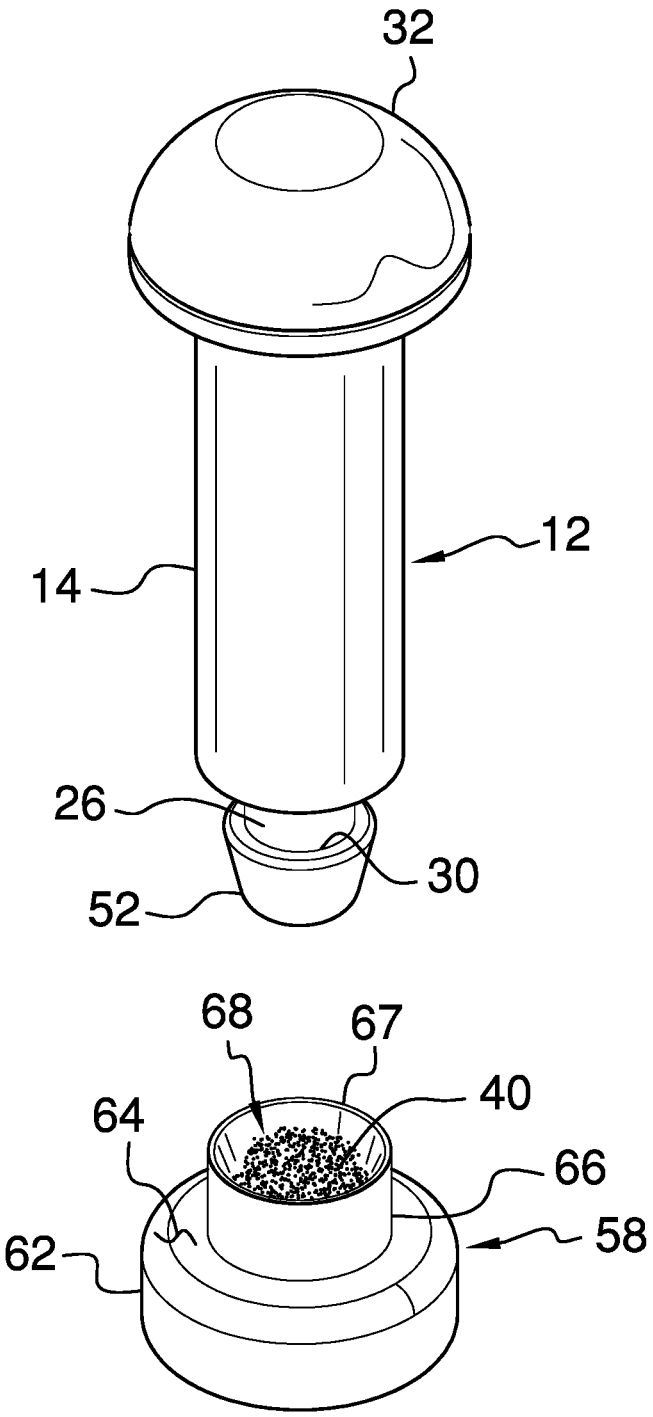
FIG. 5 is a perspective in-use view of an embodiment of the disclosure.

With reference now to the drawings, and in particular to FIGS. 1 through 5 thereof, a new crushing device embodying the principles and concepts of an embodiment of the disclosure and generally designated by the reference numeral 10 will be described.

As best illustrated in FIGS. 1 through 5, the pill crushing assembly 10 generally comprises a plunger unit 12 that may be manipulated. The plunger unit 12 comprises a tube 14 that has a first end 16, a second end 18 and an inner surface 20. A lip 22 extends inwardly from the inner surface 20. The lip 22 is continuous such that the lip 22 forms a ring extending around the tube 14. The lip 22 has an upwardly facing surface 24.

A shaft 26 is provided. The shaft 26 has a primary end 28 and a secondary end 30. The shaft 26 is slidably positioned within the tube 14. A dome 32 is coupled to the primary end 28 of the shaft 26 and the dome 32 may be depressed.

The dome 32 comprises a disk 34 that has a first surface 36 and a second surface 38. The first surface 36 is positioned on the primary end 28 of the shaft 26. A pair of ridges 39 extends upwardly from the second surface 36 and the ridges 39 are oriented to form a V shape. A pill 40 is selectively placed between the ridges 39 such that the ridges 39 inhibit the pill 40 from sliding the second surface 38. The pill 40 may be oral medication or the like.

A lid 42 is hingedly coupled to the second surface 38 of the disk 34. The dome 32 is selectively depressed when the lid 42 is positioned in a closed position. The lid 42 has an interior surface 44. A blade 46 is coupled to the interior surface 44 of the lid 42. The blade 46 has a distal edge 48 with respect to the lid 42. The distal edge 48 is sharpened to cut the pill 40 in half when the lid 42 is positioned in the closed position. Additionally, the blade 46 passes between the pair of ridges 39 when the lid 42 is positioned in the closed position.

A biasing member 50 is positioned around the shaft 26. The biasing member 50 extends between the upwardly facing surface 24 of the lip 22 and the first surface 36 of the disk 34. The biasing member 50 biases the shaft 26 to extend outwardly from the first end 16 of the tube 14. Moreover, the shaft 26 is selectively urged downwardly in the tube 14 when the dome 32 is depressed. The biasing member 50 may be spring biasing member 50.

A crusher 52 is provided. The crusher 52 is coupled to the secondary end 30 of the shaft 26. Thus, the crusher 52 crushes the pill 40 when the shaft 26 is urged downwardly in the tube 14. The crusher 52 abuts the lip 22 when the biasing member 50 biases the shaft 26 outwardly from the tube 14. Thus, the shaft 26 is retained in the tube 14. The crusher 52 may have a distal end 54 with respect to the shaft 26 and an outer surface 56. The outer surface 56 may taper inwardly between the shaft 26 and the distal end 54.

A base 58 provided and the base 58 may be positioned on a support surface 60. The support surface 60 may be a table top or the like. The pill 40 is positioned on the base 58 when the pill 40 is to be crushed. The plunger unit 12 is selectively positioned on the base 58. Thus, the plunger unit 12 selectively crushes the pill 40 on the base 58.

The base 58 comprises a platter 62 that has a primary surface 64. The platter 62 is positioned on the support surface 60. The second end 18 of the tube 14 abuts the primary surface 64 when the plunger unit 12 is positioned on the base 58. A stem 66 is coupled to and extends upwardly from the primary surface 64. The stem 66 extends upwardly into the tube 14 when the plunger unit 12 is positioned on the base 58.

The stem 66 has a distal end 67 with respect to the platter 62. The distal end 67 has a well 68 extending toward the platter 62. The pill 40 is positioned in the well 68 and the well has a diameter of approximately 20 mm. The well 68 has a bounding surface 70 and the crusher 52 engages the bounding surface 70 when the shaft 26 is urged downwardly in the tube 14. Thus, the pill 40 is crushed between the bounding surface 70 of the well 68 and the crusher 52.

In use, the pill 40 is positioned in the well 68. The plunger unit 12 is positioned on the base 58 and the dome 32 is urged downwardly. Thus, the pill 40 is crushed between the stem 66 and the crusher 52. The plunger unit 12 is removed from the base 58 and the crushed pill 40 is poured out of the well 68. The lid 42 on the dome 32 is selectively opened and the pill 40 is selectively placed on the second surface 38 of the disk 34. The lid 42 is manipulated into the closed position and the blade 46 cuts the pill 40.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A pill crushing assembly being configured to selectively cut and crush a pill thereby facilitating the pill to be taken, said assembly comprising:

a plunger unit being configured to be manipulated, said plunger unit comprising a tube having a first end, a second end and an inner surface, said tube having a lip extending inwardly from said inner surface, said lip being continuous such that said lip forms a ring extending around said tube, said lip having an upwardly facing surface, a shaft having a primary end and a secondary end, said shaft being slidably positioned within said tube, a crusher having a diameter greater than a diameter of said shaft and being coupled to said secondary end of said shaft, said crusher having a planar distal end relative to said shaft, said planar distal end being smooth and continuous such that an entirety of said distal end is planar, said crusher tapering extending from said secondary end of said shaft to said distal end of said crusher, and a dome being coupled to said primary end of said shaft wherein said dome is configured to be depressed, said dome comprising a disk having a first surface and a second surface, a lid being hingedly coupled to said second surface of said disk wherein said dome is configured to be depressed when said lid is positioned in a closed position, said lid having an interior surface, and a blade being coupled to said interior surface of said lid, said blade having a distal edge with respect to said lid, said distal edge being sharpened wherein said distal edge is configured to cut a pill in half when said lid is positioned in a closed position;

a base being configured to be positioned on a support surface, said base being configured to have a pill positioned thereon, said plunger unit being selectively positioned on said base wherein said plunger unit is configured to selectively crush the pill on said base by extension of said crusher towards said base.

2. The assembly according to claim 1, further comprising a biasing member being positioned around said shaft, said biasing member extending between said upwardly facing surface of said lip and said first surface of said disk, said biasing member biasing said shaft to extend outwardly from said first end of said tube, said shaft being selectively urged downwardly in said tube.

3. The assembly according to claim 2, further comprising said crusher abutting said lip when said biasing member biases said shaft outwardly from said tube such that said shaft is retained in said tube.

4. The assembly according to claim 1, wherein said base comprises a platter having a primary surface, said platter being configured to be positioned on the support surface, said second end of said tube abutting said primary surface when said plunger unit is positioned on said base.

5. The assembly according to claim 4, further comprising:

a stem being coupled to and extending upwardly from said primary surface, said stem extending upwardly into said tube when said plunger unit is positioned on said base, said stem having a distal end with respect to said platter, said distal end having a well extending toward said platter wherein said well is configured to contain the pill, said well having a bounding surface, said crusher engaging said bounding surface when said shaft is urged downwardly in said tube.

6. A pill crushing assembly being configured to selectively cut and crush a pill thereby facilitating the pill to be taken, said assembly comprising:

a plunger unit being configured to be manipulated, said plunger unit comprising:

a tube having a first end, a second end and an inner surface, said tube having a lip extending inwardly from said inner surface, said lip being continuous such that said lip forms a ring extending around said tube, said lip having an upwardly facing surface, a shaft having a primary end and a secondary end, said shaft being slidably positioned within said tube, a dome being coupled to said primary end of said shaft wherein said dome is configured to be depressed, said dome comprising:

a disk having a first surface and a second surface, said first surface being positioned on said primary end of said shaft, said second surface being configured to have a pill positioned thereon, a lid being hingedly coupled to said second surface of said disk wherein said dome is configured to be depressed when said lid is positioned in a closed position, said lid having an interior surface, and a blade being coupled to said interior surface of said lid, said blade having a distal edge with respect to said lid, said distal edge being sharpened wherein said distal edge is configured to cut the pill in half when said lid is positioned in said closed position;

a biasing member being positioned around said shaft, said biasing member extending between said upwardly facing surface of said lip and said first surface of said disk, said biasing member biasing said shaft to extend outwardly from said first end of said tube, said shaft being selectively urged downwardly in said tube, a crusher having a diameter greater than a diameter of said shaft and being coupled to said secondary end of said shaft wherein said crusher is configured to crush a pill when said shaft is urged downwardly in said tube, said crusher having a planar distal end relative to said shaft, said planar distal end being smooth and continuous such that an entirety of said distal end is planar, said crusher tapering extending from said secondary end of said shaft to said distal end of said crusher, said crusher abutting said lip when said biasing member biases said shaft outwardly from said tube such that said shaft is retained in said tube; and a base being configured to be positioned on a support surface, said base being configured to have a pill positioned thereon, said plunger unit being selectively positioned on said base wherein said plunger unit is configured to selectively crush the pill on said base, said base comprising:

a platter having a primary surface, said platter being configured to be positioned on the support surface, said second end of said tube abutting said primary surface when said plunger unit is positioned on said base, and a stem being coupled to and extending upwardly from said primary surface, said stem extending upwardly into said tube when said plunger unit is positioned on said base, said stem having a distal end with respect to said platter, said distal end having a well extending toward said platter wherein said well is configured to contain the pill, said well having a bounding surface, said crusher engaging said bounding surface when said shaft is urged downwardly in said tube.

* * * * *